United States Patent [19]

Hooper

[11] Patent Number: 4,630,591

[45] Date of Patent: Dec. 23, 1986

[54] STRATIFIED CHARGE INTERNAL COMBUSTION ENGINES

[75] Inventor: Bernard Hooper, Stourbridge, England

[73] Assignee: National Research Development Corporation, London, England

[21] Appl. No.: 831,069

[22] Filed: Feb. 20, 1986

Related U.S. Application Data

[63] Continuation of Ser. No. 467,166, Feb. 16, 1983, abandoned.

[30] Foreign Application Priority Data

Feb. 17, 1982 [GB] United Kingdom ..... 8204716

[51] Int. Cl.[4] ..... F02B 75/02

[52] U.S. Cl. ..... 123/65 S; 123/52 MF; 123/73 F

[58] Field of Search ..... 123/59 BS, 73 B, 66, 123/65 S, 74 R, 73 AV, 73 A, 73 PP, 73 B, 73 BA, 73 V, 73 R, 73 F, 74 B, 295, 430, 303, 52 MF

[56] References Cited

U.S. PATENT DOCUMENTS

| | | | |
|---|---|---|---|
| 1,013,955 | 1/1912 | Roberts | 123/73 B |
| 1,250,715 | 12/1917 | Toomey | 123/59 BS |
| 1,527,166 | 2/1925 | Bezu | 123/73 B |
| 1,771,552 | 7/1930 | Tower | 123/73 BA |
| 2,376,968 | 5/1945 | Jones | 123/59 BS |
| 4,067,302 | 1/1978 | Ehrlich | 123/73 PP |
| 4,258,670 | 3/1981 | Thery | 123/73 B |

FOREIGN PATENT DOCUMENTS

| | | | |
|---|---|---|---|
| 56222 | 5/1977 | Japan | 123/66 |
| 859487 | 1/1961 | United Kingdom . | |
| 977468 | 12/1964 | United Kingdom . | |
| 1353288 | 5/1974 | United Kingdom . | |
| 1447773 | 9/1976 | United Kingdom . | |
| 1538852 | 1/1979 | United Kingdom . | |

*Primary Examiner*—Ira S. Lazarus
*Assistant Examiner*—David A. Okonsky
*Attorney, Agent, or Firm*—Cushman, Darby & Cushman

[57] ABSTRACT

A stratified-charge two-stroke internal combustion engine of the kind in which a rich mixture of fuel and air reaches each cylinder from an auxiliary transfer passage, and further air from a main transfer passage. The fuel-supply device for each cylinder is located in the auxiliary transfer passage well upstream of its entry into the cylinder so that substantial mixing of fuel and air takes place before entry. The rate of fuel supply is typically simply related to conditions in the auxiliary passage, and may be governed by a carburetor-type device located there or by a pressure-sensitive device located there and controlling a pump delivering through an injector. Multi-cylinder designs are described with a single fuel-supply device located in an auxiliary passage common to all the cylinders. Also the use of pistons of stepped form in which the face of one step takes the firing force by which that piston is driven, and the face of the other step exerts the pumping action by which combustion air is delivered to another cylinder by way of the auxiliary passage.

7 Claims, 7 Drawing Figures

"PRIOR ART"

"PRIOR ART"

"PRIOR ART"

STRATIFIED CHARGE INTERNAL COMBUSTION ENGINES

This is a continuation of application Ser. No. 467,166, filed Feb. 16, 1983, which was abandoned upon the filing hereof.

This invention relates to two-stroke internal combustion engines of the kind in which the ports of each cylinder are so arranged that as each charge is fed to the cylinder, the gases within the cylinder tend to form into distinct transverse layers or "strata", the composition of each layer or stratum being different. Such engines will be referred to as "stratified-charge", or "SC" engines.

The cylinder of an SC engine requires ports of three kinds. First, at least one exhaust port through which spent charge leaves the cylinder. Secondly, at least one port known as an auxiliary transfer port, located in the cylinder wall opposite the exhaust port or ports: through the auxiliary transfer port or ports, a rich fuel-/air mixture enters the cylinder. Thirdly, at least two main transfer ports, located opposite each other and one to each side of the diameter joining the exhaust ports to the auxiliary transfer ports. The main transfer ports supply the bulk of the air required for the firing of the charge, and supply none of the fuel. FIGS. 1 to 3 of the accompanying drawings are diagrammatic transverse sections through typical cylinders of three different SC engines. In FIG. 1 the cylinder 1 has a single exhaust port 2 located diametrically opposite a single auxiliary transfer port 3, and two main transfer ports 4, 5. When the cylinder is charged, following the introduction of the rich fuel/air mixture through port 3 and of air only through ports 4 and 5, the charge tends to be arranged in three layers 6, 7 and 8, the approximate boundaries between which are indicated by the broken lines 9, 10. The gas in layer 6 is predominantly spent gas from the previous charge, and is located closely around the mouth of exhaust port 2. The layer 7 consists of the rich fuel/air mixture recently admitted through auxiliary transfer port 3, and is located close to the mouth of that port. Between layers 6 and 7 lies the layer 8 consisting of pure air admitted through main transfer ports 4 and 5. This air is of course required for combustion of the charge once firing has taken place, but prior to firing it tends to act as a "wall" between layers 6 and 7, one valuable effect of which is to inhibit the passage of raw fuel vapour straight across the cylinder from port 3 to port 2. Such passage of fuel is not only wasteful but also raises the proportion of unburnt hydrocarbons in the exhaust gases, commonly to above the level set down by the increasing number of regulations now in force on this subject. FIG. 1 also clearly shows that main transfer ports 4 and 5 do not enter the cylinder exactly at right angles to the diameter adjoining ports 2 and 3, but at an angle so that the gas they introduce has a considerable resultant motion towards port 3: it is well known in the art this is vital in practice if three distinct layers 6, 8 and 7 are to be formed, although it is not relevant to the present invention which will shortly be defined and described.

FIG. 2 shows a cylinder 1 with a pair of auxiliary transfer ports 3*a* and 3*b* and a comparable exhaust port presenting dual mouths 2*a* and 2*b* which quickly merge into a single exhaust passage behind a dividing rib 11. Two main transfer ports 4*a* and 4*b*, lying to one side of the inlet-exhaust diameter, are balanced by two further main ports 5*a*, 5*b* to the other side, and again the resultant motion of the air introduced through main ports 4 and 5 has a considerable component towards the auxiliary port 3. In the construction shown in FIG. 3 there are again two main transfer ports (4*a*, 4*b* and 5*a*, 5*b*) to either side of the inlet-exhaust axis, and in this construction there is a single exhaust port 2 and the axes of the two auxiliary transfer ports 3*a*, 3*b* do not lie parallel to the exhaust axis as in the previous Figures, but are symmetrically angled towards it much as the main transfer ports are, but so that the resultant motion of the fuel/air mixture that is introduced through these auxiliary ports is directed towards the exhaust port 2.

Recent developments in the design of automobile engines have been concentrated upon four-stroke designs, and have coincided with an increasing awareness of the dangers of exhaust pollution and with the passing of much restrictive legislation on this subject by many countries. Partly from this cause, the fuel introduction systems of many recent designs of four-stroke engines have been sophisticated and therefore expensive, usually involving a complex electronic mechanism which continuously monitors the performance of the engine and which both accurately meters each fuel charge for each cylinder and in many of the designs accurately times the introduction of that charge. Now whereas four-stroke engines and the vehicles that carry them tend to be relatively large and costly structures, so that the extra cost of such a sophisticated fuel supply mechanism is relatively small compared with the cost of the whole, with a two-stroke engine it is different and an electronic fuel supply system adds so heavily to the cost of the whole as to make it commercially unattractive. A consequence of increasing concern about exhaust pollution has therefore been that relatively little interest has recently been shown in two-stroke SC engines.

The present invention is based upon realising that with a two-stroke engine the improvements in efficiency and exhaust emission characteristics, achieved simply by changing from a conventional to a stratified-charged design, are unexpectedly great. So great, in fact, that when a novel but simple method of fuel supply is used, the improvements over the conventional design remain so substantial that the engine in performance will satisfy many modern legislative requirements where a conventional two-stroke engine would not. According to the present invention a stratified-charge two-stroke internal combustion engine comprises at least one cylinder having a main transfer passage system for the supply of air, and an auxiliary transfer passage system by means of which a rich fuel/air mixture is supplied to the cylinder. Fuel supply means are located in the auxiliary transfer passage system upstream of its entry into the cylinder so that substantial mixing of fuel and air has taken place between the means and the cylinder, and there are means to regulate the rate of supply of fuel so that it bears a predetermined relationship to a gas parameter existing at a predetermined location within the engine.

The fuel supply means may comprise a carburettor or other naturally-aspirated device responsive directly to the air flow in the auxiliary transfer passage where it is located. Alternatively the fuel supply means may be in the form of an injector delivering into the auxiliary transfer passage and supplied by a fuel pump, the rate of delivery of the injector being matched to the pressure in the auxiliary transfer passage or elsewhere in the engine.

Preferably the engine comprises at least two cylinders connected in parallel to a common transfer passage, the fluid supply means for all these connected cylinders being located at a single point in that passage. The crankcases of the cylinders may be separated one from the other so that the crankcase of each cylinder acts as an individual pumping device controlling the supply of air that enters that cylinder by way of the auxiliary transfer passage system: each crankcase may communicate by way of a reed or other non-return valve with a manifold having a single outlet leading to the single point fuel supply means and through it to the common transfer passage.

The invention applies particularly to multi-cylinder engines with stepped pistons, where one step of each piston takes the firing force by which that piston is driven, and the working space of the other step is connected to the auxiliary transfer passage system of another piston and serves to exert the pumping action required to deliver the combustion air to that second cylinder. In this case the pumping parts of the cylinders may be connected by way of reed or other non-return valves to the manifold and thence, by way of the single-point fuel supply device, to a common auxiliary transfer passage to which each of the cylinders is connected in parallel.

The invention will now be described, by way of example, with reference to the Figures of the accompanying drawings in which.

Figure 1:
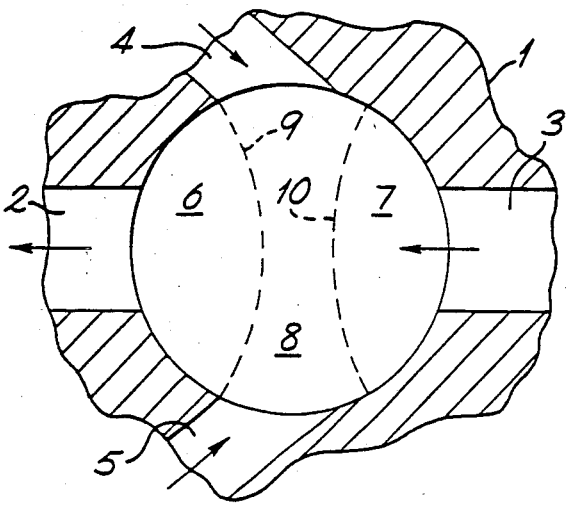
FIGS. 1 through 3 are diagrammatic transverse sections through typical cylinders of three different stratified-charge engines.
Figure 2:
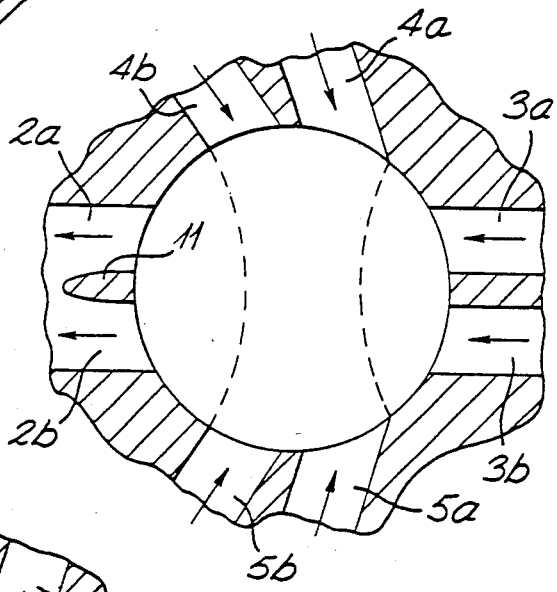
Figure 3:
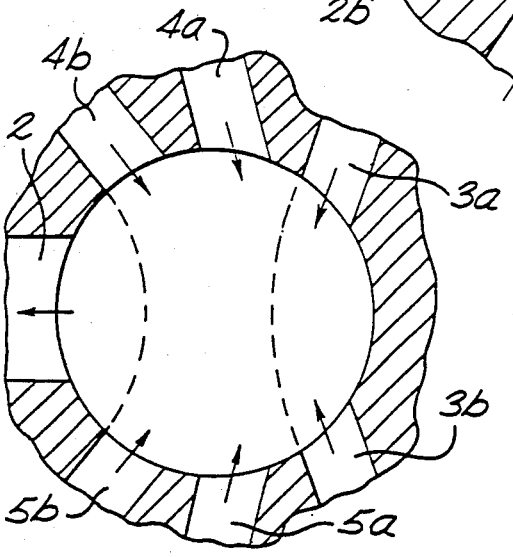
Figure 4:
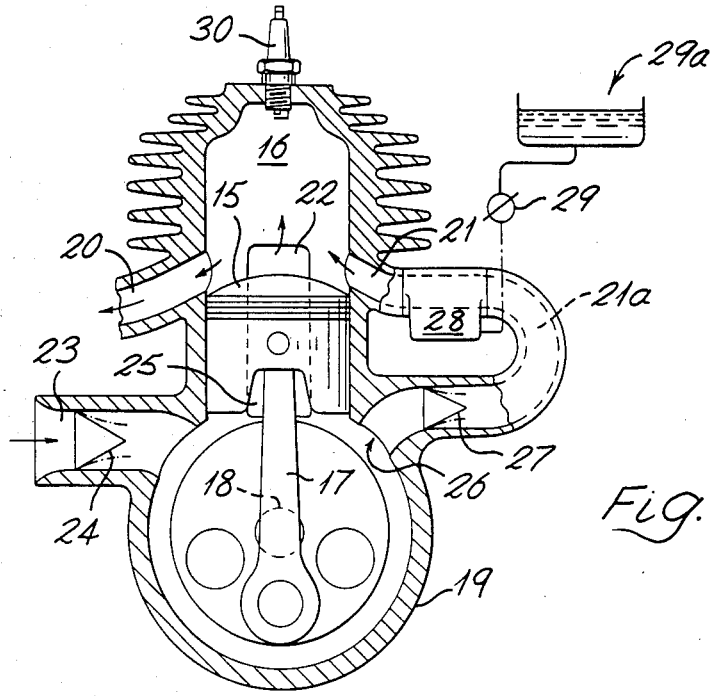
FIG. 4 is a section through a single-cylinder conventional-piston engine.

FIG. 4 shows an engine comprising a conventional piston 15 moving within a cylinder 16. By way of a connecting rod 17, piston 15 drives a crankshaft 18 located in bearings (not shown) within a crankcase 19. The ports of cylinder 16 are arranged so that stratified-charge operation is achieved: there is a single exhaust passage 20, the port of which is located diametrically opposite the port of a single auxiliary transfer passage 21. Between the two, and located opposite each other, are the ports of two main transfer passages: the port of passage 22 is shown, while the other passage lies in front of the plane of section of the Figure. Crankcase 19 has an air inlet 23 containing an induction reed valve 24, and three air outlets. Two of these outlets, of which one (25) is shown, lead to the main transfer passages 22. The remaining outlet 26 leads by way of a transfer reed valve 27 to auxiliary transfer passage 21, in which is located a fuel supply device 28 connected by a pump 29 to a fuel reservoir shown diagrammatically at *29a*. Device 28 may typically be similar in construction and operation to an ordinary carburettor, containing a float chamber maintained at the pressure existing in the part 21*a* of passage 21 that lies upstream of device 28. Fuel in vapour form is drawn from device 28 at a rate related to that at which the air in passage 21 is flowing past the device. Piston 15 is shown at bottom dead center, at the end of a power stroke, during the latter part of which fresh charges of air and fuel have entered cylinder 16. As piston 15 now rises on the succeeding compression stroke, reed valve 27 closes but valve 24 opens to admit air to crankcase 19 by way of inlet 23. Once the piston has reached top dead center and started to descend on the next power stroke after ignition by plug 30, valve 24 closes and the pumping action of the descending piston drives air from crankcase 19 into cylinder 16 by two routes; firstly through outlets 25 and main transfer passages 22, to form the middle stratum or layer of pure air in the next cylinder charge; secondly by way of valve 27, now open, through the auxiliary transfer passage 21 and device 28 where fuel vapour is induced into the air at a rate proportional to the rate of flow of the air itself. Air and fuel vapour mix in the remaining length of passage 21 lying between device 28 and cylinder 16: this length must be great enough therefore to allow substantial mixing and will typically well exceed the diameter of the passage. As shown in FIG. 1 the mixture that enters the cylinder forms the distinct layer 7, the geometry of the exhaust and transfer passages being chosen so that clear boundaries (9, 10) are achieved between the layers.

Figure 5:
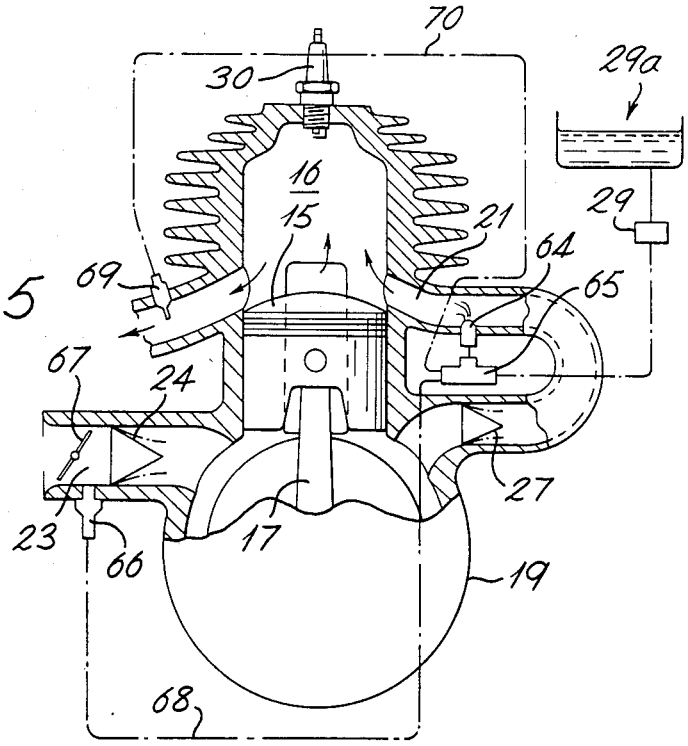
FIG. 5 is a similar section through a modified version of the same engine.

The invention is not confined to engines in which the rate of introduction of vapourised fuel into auxiliary transfer passage 21 depends directly upon the rate of flow of air within that passage. As an alternative, the fuel could be directly injected into the passage, at a rate related to a pressure level existing in the engine. For instance, as shown in FIG. 5, a fuel injector nozzle 64 may be supplied with fuel from reservoir *29a* by pressure pump 29, the quantity of the fuel so supplied being controlled by a regulating valve device 65 which responds to signals from a pressure sensor 66 adjacent to a throttle valve 67 located in induction inlet 23 closely upstream of induction reed valve 24. The connection between sensor 66 and device 65 is indicated diagrammatically at 68. The control system may also include an additional sensor 69, having a connection 70 to device 65 and monitoring exhaust gas temperature: further sensors monitoring yet other parameters may be added according to the degree of control required for a particular application.

Figure 6:
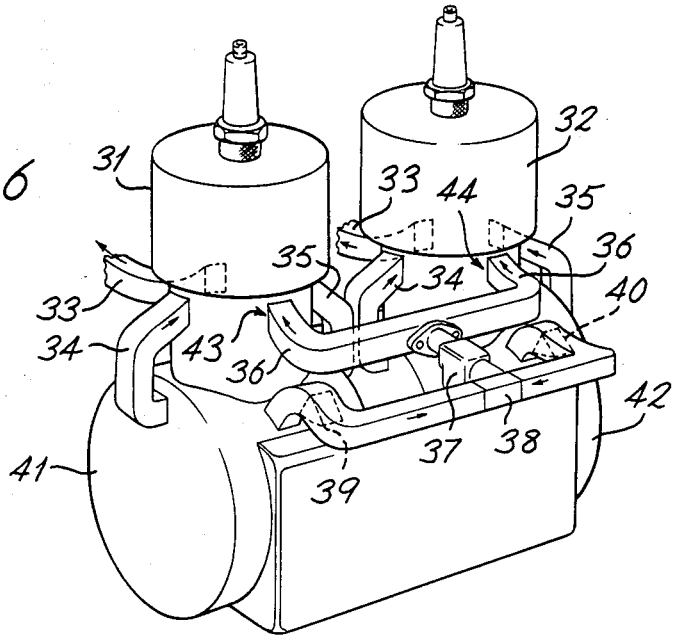
FIG. 6 is a simplified perspective view of a twin cylinder conventional-piston engine.

FIG. 6 shows a twin cylinder, two-stroke engine in which each of the two cylinders (31, 32) has a single exhaust passage 33 and a pair of opposed main transfer passages 34, 35. Each cylinder also has a single port by which it is connected to a common auxiliary transfer passage 36, which in turn communicates with a single fluid supply device 37 and thence, by way of a manifold 38 and reed valves 39 and 40, with the separate crankcases 41, 42 of cylinders 31, 32 respectively. The crankcase of each cylinder now acts as the pumping device for that cylinder just as the crankcase 19 of the individual cylinder of FIG. 4 did, by the single fuel supply device 37 suffices because as each piston in turn executes its pumping stroke only the reed valve (39 or 40) associated with that cylinder will be open while the other valve will be closed, and only the transfer passage port (43 or 44) associated with that cylinder will admit fuel/air mixture from passage 36 because the other port will be obscured by the piston of the other cylinder which runs 180° out of phase.

Figure 7:
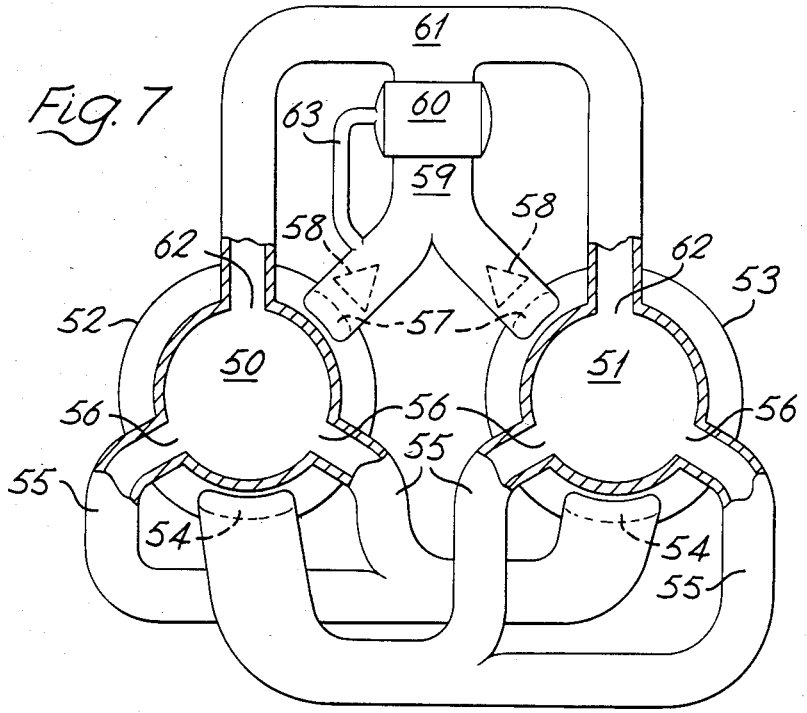
FIG. 7 is a transverse section through a twin cylinder, stepped-piston engine.

FIG. 7 shows a twin-cylinder, two-stroke engine using stepped pistons. The pistons themselves are omitted from the Figure, and the section is taken through the upper half of the 'working' part of each cylinder, that is to say the part that receives the charge. References 50, 51 indicate the working parts of the two cylinders, and references 52, 53 the associated 'pumping' parts, of greater diameter. Outlets 54 from the two pumping parts lead by way of main transfer passages 55 to main transfer ports 56 in working parts 50 and 51, and outlets 57 from pumping parts 52, 53 lead by way of reed valves 58 to a manifold 59 and thence by way of a fuel supply device 60 to a common transfer passage 61 which enters working parts 50, 51 at ports 62. In contrast to the constructions shown in FIGS. 4 and 5, where the power stroke of a cylinder served to pump the succeeding charge of that same cylinder, in the construction of FIG. 7 the outlets 54, 57 are located in the upper part of cylinders 52, 53 and the compression stroke of the working part of one cylinder serves to pump the air for the next charge not of that cylinder, but of its twin. To simplify the drawing, the air inlets of the pumping parts 52, 53 and the exhausts of the working parts 50, 51 are omitted: the working part exhausts would, of course, lie diametrically opposite the auxiliary transfer ports 62. If device 60 is of naturally-aspirated type, passage 63 establishes communication and therefore the necessary equality of pressure between manifold 59 and the float chamber or similar member of device 60.

A particular advantage of engines according to the invention that include naturally-aspirated fuel supply devices, as shown in FIGS. 4 to 7 is that, by locating the devices actually in the path of the gases flowing along the auxiliary transfer passages, the heat generated by the pumping action warms the devices very quickly as soon as the engine is started, thus shortening the period during which the engine needs 'choking' and thus runs at diminished efficiency.

What is claimed is:

1. A stratified-charge, stepped piston, two-stroke internal combustion engine comprising:

at least first and second stepped cylinders;

a first stepped piston movable within said first stepped cylinder and defining therewith first and second working spaces of variable volume, said first working space constituting a volume in which a firing force is generated by which said first piston is driven, and said second working space being adapted to contribute to a pumping action;

a second stepped piston movable within said second cylinder and defining therewith third and fourth working spaces of variable volume, said third working space constituting a volume in which a firing force is generated to drive said second piston and said fourth working space being adapted to contribute to a pumping action;

a first connection between said second working space and said third working space and a second connection between said fourth working space and said first working space, said first and second connections being without intercommunication and serving main transfer passages wherein combustion air necessary for the generation of the firing forces operable upon said second and first pistons is generated;

a third connection between said second working space and said third working space and a fourth connection between said fourth working space and said first working space;

said third and fourth connections being interconnected at a meeting point, a first non-return valve positioned in said fourth connection between said fourth working space and said meeting point, wherein said third and fourth connections are adapted to act as a common auxiliary transfer passage system such that further combustion air may pass from said second to said third working space and from said fourth to said first working space;

fuel supply means for supplying fuel to be mixed with said further combustion air flowing to said first and said third working spaces, and located within said auxiliary transfer passage system in proximity to said meeting point; and regulator means being provided within said fuel supply means and associated with the flow of said further combustion air within said auxiliary transfer passage system in proximity to said meeting point, for regulating the rate of said supply of fuel so that said rate of fuel supply bears a predetermined relationship to said air flow within said auxiliary transfer passage system.

2. An internal combustion engine according to claim 1 wherein said fuel supply means comprises a naturally-aspirated device responsive directly to said air flow within said auxiliary transfer passage system.

3. An internal combustion engine according to claim 1 in which said fuel supply means comprises an injector type device, and in which said regulating means controls the delivery of fuel from said injector-type device so that the delivery of the fuel bears said predetermined relationship to said air flow within said auxiliary transfer passage system.

4. An engine according to claim 1 in which said fuel supply means is in the form of an injector which delivers into said auxiliary transfer passage system, in which a fuel pump supplies said injector, and in which the rate of delivery of said injector is regulated to bear said predetermined relationship to said air flow within said auxiliary transfer passage system.

5. An engine according to claim 4 in which said rate of delivery of said injector is regulated to bear said predetermined relationship to the air flow pressure in said auxiliary transfer passage system.

6. An engine according to claim 1 in which:

each said cylinder drives a crank, working within a crankcase;

each said crankcase associated with an individual said cylinder is separate from said other crankcases, and each said separate crankcase is connected to its associated said cylinder by way of said auxiliary transfer passage system and acts as a pumping device controlling the supply of said air that enters said associated cylinder by way of said system.

7. An engine according to claim 6 comprising:

a manifold;

a single outlet from said manifold leading to said fuel supply means and thereby to said common auxiliary transfer passage system, and, separate inlets, each containing a non-return valve and connecting said manifold to each of said separate crankcases.

* * * * *